US011536500B2

(12) United States Patent
Sus et al.

(10) Patent No.: US 11,536,500 B2
(45) Date of Patent: Dec. 27, 2022

(54) BRACKET FOR A RECEIVER DRIER

(71) Applicant: Valeo Autosystemy Sp. z o.o., Skawina (PL)

(72) Inventors: Pawel Sus, Bietigheim-Bissingen (DE); Mateusz Kaczmarczyk, Skawina (PL); Karol Pokrywinski, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 247 days.

(21) Appl. No.: 16/638,300

(22) PCT Filed: Aug. 14, 2018

(86) PCT No.: PCT/EP2018/072013

§ 371 (c)(1),
(2) Date: Feb. 11, 2020

(87) PCT Pub. No.: WO2019/034647

PCT Pub. Date: Feb. 21, 2019

(65) Prior Publication Data

US 2020/0224943 A1 Jul. 16, 2020

(30) Foreign Application Priority Data

Aug. 17, 2017 (EP) ..... 17461588

(51) Int. Cl.
*F25B 43/00* (2006.01)
*F25B 39/00* (2006.01)

(52) U.S. Cl.
CPC ..... *F25B 43/00* (2013.01); *F25B 39/00* (2013.01); *F25B 43/003* (2013.01);
(Continued)

(58) Field of Classification Search
CPC ..... F25B 39/00; F25B 43/00; F25B 43/003; F25B 2339/044; F25B 2339/0442; F25B 2339/0446; F25B 2400/24
See application file for complete search history.

(56) References Cited

U.S. PATENT DOCUMENTS 5,901,573 A 5/1999 Kobayashi
6,694,773 B1 * 2/2004 Snow ..... F25B 39/04 62/474
2012/0291478 A1 * 11/2012 Kim ..... B60H 1/3227 62/507

FOREIGN PATENT DOCUMENTS

CN 1494649 A 5/2004
CN 203364512 U 12/2013
(Continued)

OTHER PUBLICATIONS

Machine translation of WO 2007/141982 (Year: 2007).*
(Continued)

*Primary Examiner* — Joseph F Trpisovsky
(74) *Attorney, Agent, or Firm* — Osha Bergman Watanabe & Burton LLP

(57) ABSTRACT

A heat exchanging module (1) comprising a heat exchanger (2) and a bottle (6), the bottle (6) being attached to the heat exchanger (2) at one first longitudinal end (63) of the bottle (6), said heat exchanging module (1) comprising at least one attachment mean (10) located at a second longitudinal end (64) of the bottle (6), said attachment mean (10) restricting at least one axial movement of the bottle (6) along a longitudinal dimension (5) of said bottle (6).

11 Claims, 3 Drawing Sheets

(52) U.S. Cl.
CPC . *F25B 2339/044* (2013.01); *F25B 2339/0442* (2013.01); *F25B 2339/0446* (2013.01)

(56) References Cited

FOREIGN PATENT DOCUMENTS

| | | | | |
|---|---|---|---|---|
| CN | 204100657 | U | 1/2015 | |
| EP | 1310748 | A2 | 5/2003 | |
| FR | 2825459 | A1 * | 12/2002 | ..... F25B 39/04 |
| JP | H0875317 | A | 3/1996 | |
| JP | 4719555 | B2 | 7/2011 | |
| WO | 2007/141982 | A1 | 12/2007 | |

OTHER PUBLICATIONS

Machine translation of FR2825459 (Year: 2002).*
International Search Report and Written Opinion corresponding to International Patent Application No. PCT/EP2018/072013, dated Oct. 18, 2018 (8 pages).
The First Office Action in corresponding Chinese Application No. 201880063661.5, dated May 7, 2021 (13 pages).

* cited by examiner

BRACKET FOR A RECEIVER DRIER

The present invention relates to heat exchangers, especially heat exchangers used in air conditioning systems for automotive vehicle.

Heat exchangers, and particularly liquid-cooled condensers, are designed to enable the circulation of a coolant fluid and a refrigerant fluid in adjacent but yet separated spaces, to allow the exchange of heat between the fluids. These exchanges cause a change in the state of the refrigerant fluid, from gas to liquid. The refrigerant fluid is pumped through the refrigerant circuit by a compressor, which can only accept the refrigerant fluid in a gas state.

A receiver drier bottle is implemented in the refrigerant fluid circuit to collect and trap liquid and moisture out of the refrigerant fluid, as well as for filtering purposes. Due to the way this bottle is attached to a heat exchanger, the bottle tends to vibrate, which can cause damage to the junction between the bottle and the heat exchanger on which it is located.

Some solutions were developed to solve this problem. Unfortunately, said solutions do not fulfill their aim entirely, as they either consume a lot of space, a scarce resource in an engine compartment, or require altering or designing an entire new way to hold the bottle.

The invention aims at offering an alternative to the existing yet incomplete solutions to the problem exposed here above, by allowing a compact and efficient attachment of the bottle on the heat exchanging module without the need to modify any part of the air conditioning system; and which ensure a minimal space consumption.

An object of present invention is a heat exchanging module comprising a heat exchanger and a bottle, the bottle being attached to the heat exchanger at one first longitudinal end of the bottle, said heat exchanging module comprising at least one attachment means located at a second longitudinal end of the bottle, said attachment means restricting at least one axial movement of the bottle along a longitudinal dimension of said bottle.

A heat exchanging module according to this description allow the restriction of the movement of the bottle in the longitudinal extension of the bottle, without a space-costly arrangement of the refrigerant fluid circuit. An additional advantage of this invention is that the modification of the heat exchanging module necessary to the accommodation of the invention is minimal, which allows to cut the cost of conception. Yet another advantage lies in the fact that the attachment means does not damage the bottle, either during its set-up or if the elements need to be separated for maintenance or replacement.

The heat exchanging module according to the invention comprises at least one of the following parameters, either alone or in combination with another:

the attachment means restricts a movement of the bottle in a direction perpendicular to the longitudinal dimension of the bottle. The longitudinal dimension of the bottle is the direction along which the bottle extends in its largest dimension; said in other words, the longitudinal dimension of the bottle crosses the coupling means and a terminal end of the bottle;

the attachment means comprises at least one portion extending in a plane perpendicular to the longitudinal dimension of said bottle;

said portion is located at a longitudinal end of the bottle. The portion covers at least partially said longitudinal end. Said portion abuts against a terminal end of the bottle; Said longitudinal end is located at an opposite position of the coupling means of the bottle onto the heat exchanger, the attachment means comprises a stop portion extending in a plane perpendicular to the longitudinal dimension of the bottle and abutting against a terminal end of the bottle;

said portion comprises at least two radial projections separated from one another by a gap. In another embodiment, the portion comprises more than two radial projections, two radial projections being separated from one another by a gap. In an embodiment, said radial projection are arranged regularly around the portion;

the coupling means comprises a mounting bracket and a mounting means, the mounting bracket comprising at least one duct which connect the bottle to the heat exchanger. In an embodiment, the mounting means is a screw and there are two ducts arranged inside the mounting bracket;

the attachment means comprises a circular portion meant to fit at least partially around the bottle;

in a particular embodiment, the circular portion fit all around the bottle on a given plane. Said given plane is perpendicular to the longitudinal dimension of the bottle. The bottle is entirely encircled by the circular portion on at least one section of the bottle, without interruption;

in another embodiment, the circular portion fit only partially around the bottle on a given plane. Said given plane is perpendicular to the longitudinal dimension of the bottle. The circular portion leaves a gap on the bottle where said bottle is free from the circular portion. The circular portion may be combined with the portion that abuts against a terminal end of the bottle and that extends in a plane perpendicular to the longitudinal dimension of the bottle;

the heat exchanging module comprises a frame, the attachment means being mechanically connected to the frame;

the attachment means comprises a first connection means, and a second connection means, both first connection means and second connection means being connected to the frame;

the frame comprises at least a side wall and an end wall, the attachment means is connected to the side wall of the frame by the first connection means, and to the end wall of the frame by the second connection means. The end wall is the part of the frame which is located at the opposite side of the heat exchanger compared to the bottle. The side wall of the frame extends perpendicularly to the end wall of the frame;

the frame comprises at least a first side wall, a second side wall and an end wall in between said first side wall and said second side wall, the attachment means is connected to the first side wall of the frame by the first connection means, and to the second side wall of the frame by the second connection means. The first side wall and the second side wall extend parallel each other. The first side wall of the frame extends on a first side of the heat exchanger, the second side wall of the frame extending on a second side of the heat exchanger opposed to said first side of the heat exchanger, the first connection means and the second connection means extend in opposite sense in parallel directions.

First connection means extends toward the coupling means, while the attachment means extends away from the coupling means;

the first connection means comprises a mounting clip. In another embodiment, first connection means comprises a hook;

the second connection means comprises a screw. In another embodiment, second connection means comprises a click-in mean;

the attachment means comprises at least one securing means that secures the bottle on the attachment means;

the securing means comprising at least one mounting clip, and at least one groove which at least partially receives the mounting clip. In a particular embodiment, the mounting clip is located on the attachment means, the groove being located on the bottle;

the frame is made of metal and/or synthetic material. In a particular embodiment, a part of the frame is made of metal, another part being made of synthetic material;

the connection between the attachment means and the frame is reversible. Said reversible connection means either the attachment means or the bottle can be replaced without having to replace the other element;

the attachment means is made of a material having vibration dampening properties;

the attachment means is made of synthetic material;

the heat exchanger is crossed by a first circuit configured to receive a refrigerant fluid and by a second circuit configured to receive a coolant fluid.

Other characteristics, details and advantages of the invention can be inferred from the description of the invention hereunder. Various embodiments are represented in the figures, wherein:

FIG. 1 features a perspective view of a heat exchanging module comprising an attachment means according to a first embodiment;

In the following description, the longitudinal dimension refers to the dimension along which extends the bottle in its greatest dimension. This longitudinal dimension is represented by reference 5 in the various drawings that will be detailed below.

Figure 1:
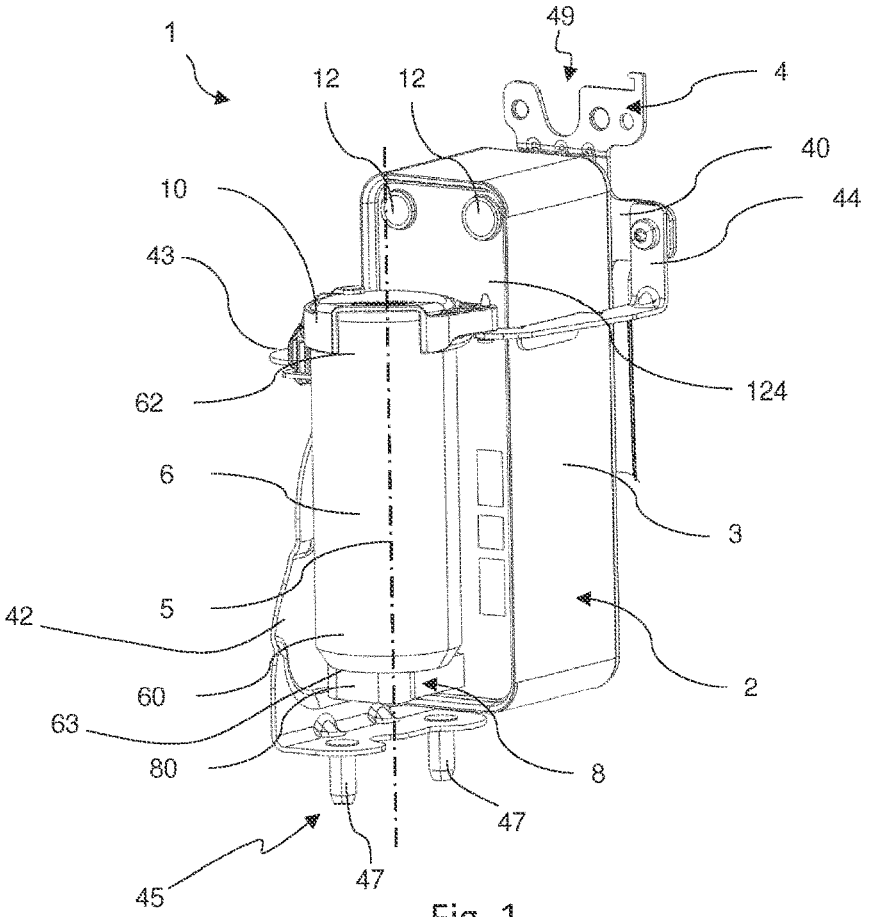

FIG. 1 represents a heat exchanging module 1 according to the invention that comprises a heat exchanger 2 and a bottle 6, said bottle 6 being supported by the heat exchanger 2. Optionally, the exchanging module 1 may comprises a frame 4 that mechanically supports the heat exchanger 2.

The heat exchanger 2 is designed to allow the circulation of a refrigerant fluid and a coolant fluid in two separated but adjacent spaces, to allow a heat exchange between these fluids. To do so, the heat exchanger 2 comprises at least four fluid openings 12, two of them being visible on FIG. 1. The exchange of heat between the fluids take place in a body 3 of the heat exchanger 2. The heat exchanger is designed to operate heat exchange only between the refrigerant fluid and the coolant fluid. In other words, the heat exchanger is not adapted to operate exchange between coolant fluid and air, or fluid refrigerant and air.

The bottle 6 is tube-shaped, and is designed to collect and trap moisture out of a fluid which circulate inside of it. The bottle 6 is receiver drier for an AC loop used in vehicle.

Said bottle 6 is connected to the heat exchanger 2 by a coupling means 8. The attachment of the bottle 6 through the coupling means 8 is located at a first portion 60 of the bottle 6. In a more precise description, the bottle 6 is attached to the heat exchanger 2 at one first longitudinal end 63 of the bottle 6, said first longitudinal end 63 being a face of the bottle that extends in a perpendicular plane versus the longitudinal dimension 5 of the bottle 6.

In this embodiment, coupling means 8 comprises a mounting bracket 80 which support the bottle 6 and a mounting screw which secure the bottle 6 onto the mounting bracket 80. The mounting bracket 80 is connected to the heat exchanger 2 and include at least one duct. Said duct is designed to allow the flow of refrigerant fluid from the heat exchanger 2 to the bottle 6, or from the bottle 6 to the heat exchanger 2 or to another element.

The heat exchanging module 1 further comprises the frame 4 designed to allow the fastening of the heat exchanger 2 and of the bottle 6, and of other elements of the heat exchanging module 1, or the fastening of the heat exchanging module 1 to an external support, for example a body of a vehicle. In this embodiment, said frame 4 comprises an end wall 40, a side wall 42 and a mounting arm 44. According to this embodiment, the frame 4 is made of metal.

The end wall 40 lies on a side of the heat exchanger 2 opposed to the bottle 6, and extend in a first plane. The side wall 42 extends in a second plane which is perpendicular to the first plane. The side wall 42 comprises a bended zone 43 that is collaborating with an attachment means 10.

A mounting arm 44 is an extension of the end wall 40, and connects to the end wall 40 by a mounting means which can be a screw, a mounting clip or any other type of mounting means. Different mounting arms 44 allow to add different types of attachment means 10.

The frame 4 is also comprising a supporting area 45 which can be made by an extension of the side wall 42 or of the end wall 40. The supporting area 45 comprise at least one finger 47, here two fingers, that allows a sliding fastening of the heat exchanging module on the vehicle. The end wall 40 comprises a fixation area 49 dedicated to attachment of the frame 4 on the body of the vehicle.

The bottle 6 is also connected to the frame 4 through the attachment means 10. Said attachment means 10 is located at a second portion 62 of the bottle 6, said second portion 62 being located at the opposite of the first portion 60 of the bottle 6 along the longitudinal dimension 5.

The attachment means 10 is connected to the frame 4, and specifically to the side wall 42 on one hand and to the end wall 40 through the mounting arm 44 on the other hand, in particular via the bended zone 43 and via the mounting arm 44.

Figure 2:
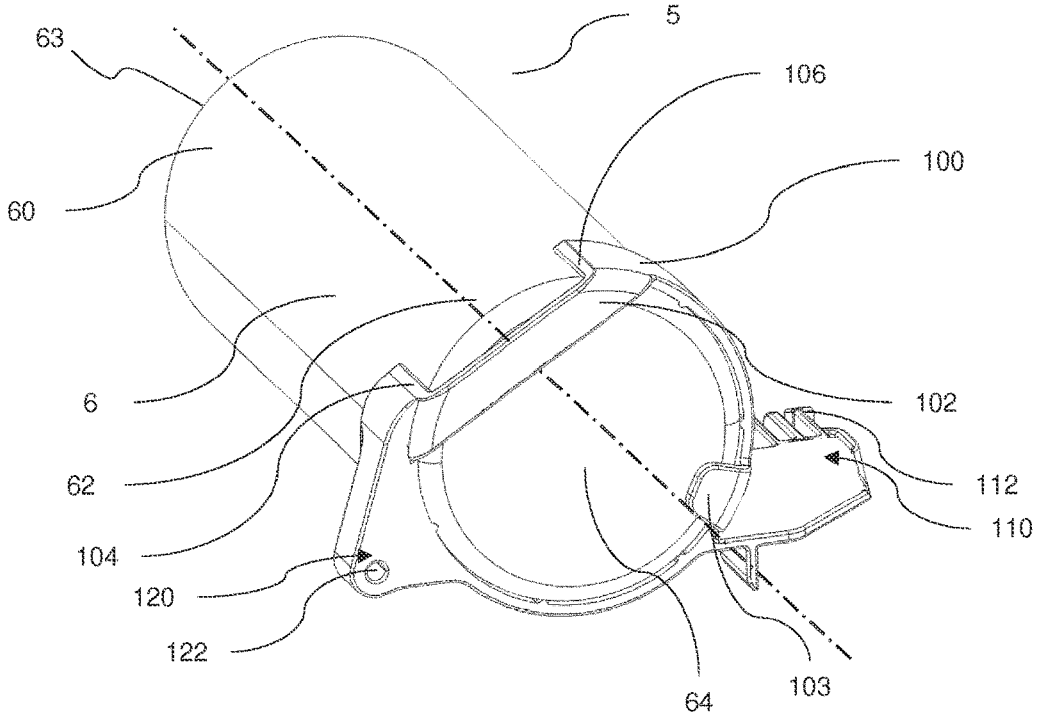
FIG. 2 is a perspective view of a bottle on which is located the attachment means.

FIG. 2 features more specifically the bottle 6 and the attachment means 10.

The attachment means 10 have a circular portion 100 which partially circle the bottle 6. A first connection means 110 and a second connection means 120 are made on the circular portion 100. Said first and second connection means are radially oriented with regards to the circular portion 100. Said first connection means 110 globally extends radially and parallel to the longitudinal dimension 5 of the bottle 6, for example toward the first portion 60 of the bottle 6. Said second connection means 120 globally extends radially and perpendicular to the longitudinal dimension 5 of the bottle 6.

The first connection means 110 is designed to allow the fixture of the attachment means 10 to the side wall 42 of the frame 4. In this embodiment, the first connection means 110 comprises a mounting clip 112 which enters a hole in the side wall 42 to partially secure the attachment means 10 on the side wall 42 of the frame 4.

The second connection means 120 is designed to allow the fixture of the attachment means 10 to the end wall 40 of the frame 4 through the mounting arm 44. In this embodiment, the second connection means 120 is connected to the mounting arm 44 by a screw 124 which collaborates with a tapped hole 122, as shown in FIG. 1.

Together, the first connection means 110 and the second connection means 120 tighten the attachment means 10 to the frame 4.

In this embodiment, both the first connection means 110 and the second connection means 120 act in parallel directions, which means that only one movement is needed to attach the attachment means 10 onto the frame 4.

Other types of connection means may be used without exiting the scope of the invention, as long as the attachment means 10 may be separated from the frame 4 without damaging one or the other. For example, any of the first connection means 110 or the second connection means 120 can be replaced by a screw, a mounting clip, a hook or any other connection means.

In the invention, the attachment means 10 limits an axial movement of the bottle 6 along the longitudinal dimension 5 of the bottle 6. It can be made in different manner, but an example is at least one portion extending in a plane perpendicular to a longitudinal dimension 5. The portion crosses the longitudinal dimension 5 and necessary enters in mechanical interference with a second longitudinal end 64 of the bottle 6, said second longitudinal end 64 being opposite to the first longitudinal end 63 of the bottle.

The portion forms a stop portion 102 that abuts this second longitudinal ends 64 of said bottle 6. Said stop portion 102 brings together a first end 104 of the circular portion 100 and a second end 106 of the circular portion 100, and lies atop the bottle 6. Atop the bottle 6 means that the stop portion 102 lies on the longitudinal end 64 of the bottle 6.

The attachment means 10 of the first embodiment comprises a large stop portion 102, and a small stop portion 103, the small one being made like an indentation.

The stop portion 102, 103 limits the movement of the bottle 6 in the longitudinal dimension. This relieves the stress upon the coupling means 8 of the bottle 6 onto the heat exchanger 2, to avoid the rupture of either the bottle 6, the coupling means 8 or the heat exchanger 2, and to lengthen the lifespan of the whole heat exchanging module 1.

The attachment means 10 may also limit the movement of the bottle 6 in a direction perpendicular to the longitudinal dimension 5. This arrangement limits the mechanical stress endured by the coupling means 8 and the risk of breaking.

It should be noted that the frame 4 is made of steel, from a single piece or made of differences pieces assembled all together to form the frame 4.

Figure 3:
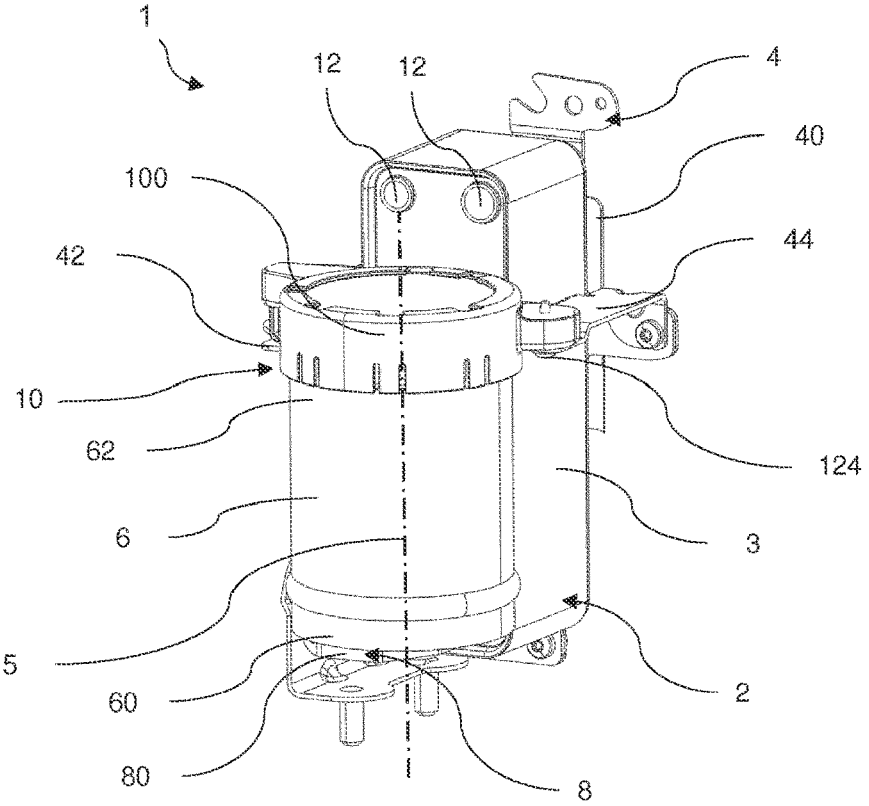
FIG. 3 represents a heat exchanging module comprising an attachment means according to a second embodiment.
Figure 4:
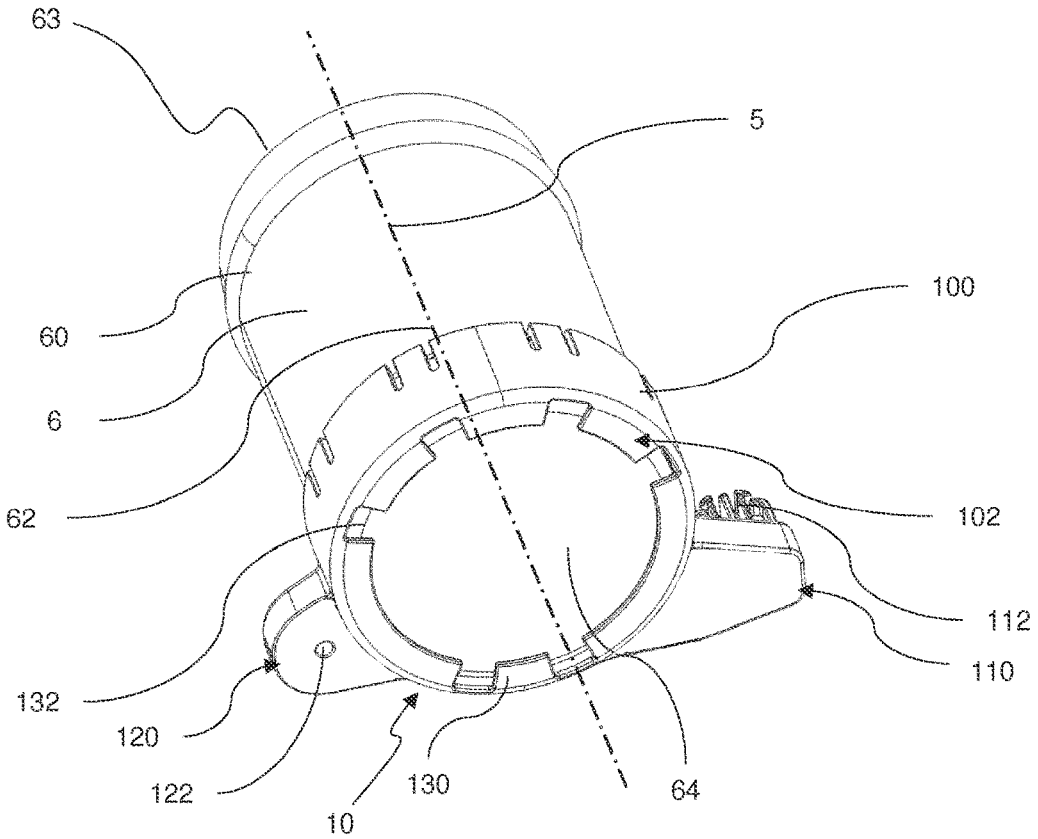
FIG. 4 is a perspective view of a bottle on which is located the attachment means according to a second embodiment.
Figure 5:
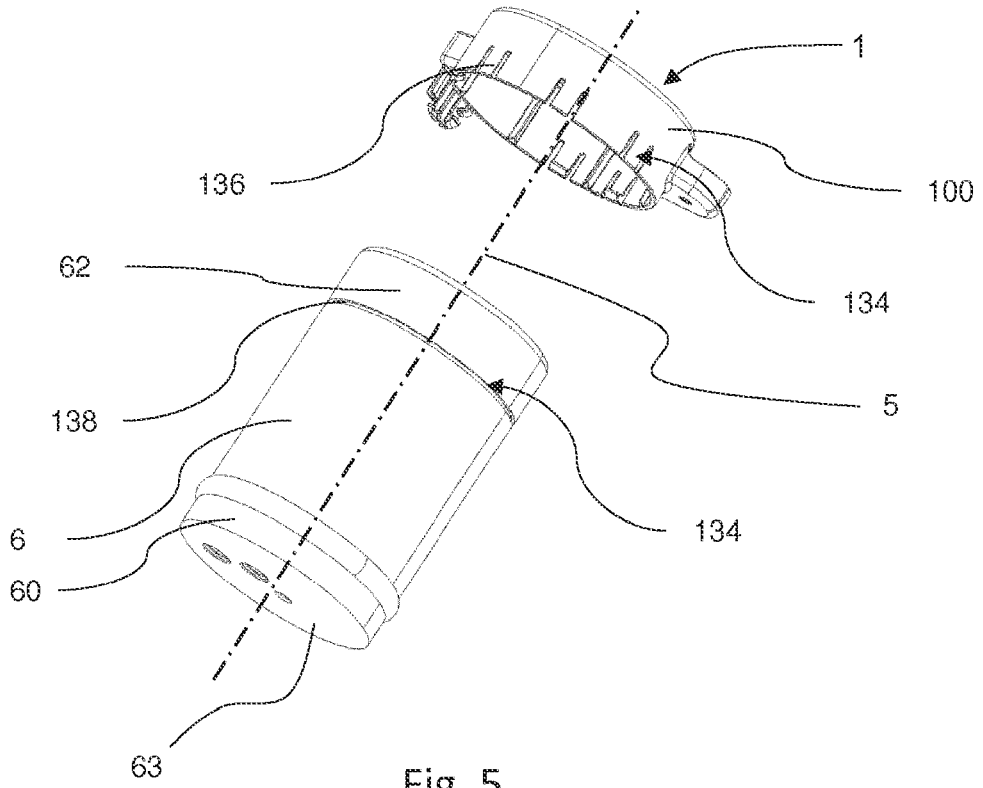
FIG. 5 is an exploded view of a bottle and the attachment means according to the second embodiment.

A second embodiment of the invention is represented in the FIGS. 3 to 5. FIG. 3 displays a heat exchanging module 1 similar to the heat exchanging module 1 of FIG. 1, in which it comprises a heat exchanger 2, a frame 4 having an end wall 40, a mounting arm 44 and a side wall 42, a bottle 6 connected to the heat exchanger 2 by a coupling means 8 comprising a mounting bracket 80, a mounting screw and at least one duct, and an attachment means 10 which attach the bottle 6 to the heat exchanging module 1, advantageously via the frame 4.

The second embodiment of the invention differs from the first embodiment especially by the structure of the attachment means 10. The similarities and differences between the two embodiments are further shown on FIG. 4.

Like the attachment means 10 of the first embodiment, the attachment means 10 of the second embodiment comprises a circular portion 100, a stop portion 102, a first connection means 110 and a second connection means 120.

The circular portion 100 extends around the second portion 62 of the bottle 6 and onto the longitudinal end 64 of said bottle 6. This particular arrangement means that the attachment means 10 is specific to a bottle 6 type of a given diameter.

The stop portion 102 comprises a plurality of radial projections 130, here six, each pair of radial projections 130 being separated by a gap 132. These radial projections 130 of the stop portion 102 fulfill the same goal as the stop portion 102 of the first embodiment, by limiting the movement of the bottle 6 in its longitudinal dimension 5.

The first connection means 110 and the second connection means 120 are configured in the very same way as in the first embodiment: the first connection means 110 comprises a mounting clip 112 which connects the attachment means 10 to the side wall 42 of the frame 4, the second connection means 120 comprises a screw 124 which collaborates with a tapped hole 122 made in the second connection means 120, as shown in FIG. 3. The first connection means 110 and the second connection means 120 have an arm that extends in a parallel plane, said plane being perpendicular to said longitudinal dimension 5. The first connection means 110 extends toward the first portion 60 of the bottle 6.

A shown in FIG. 5, the attachment means 10 further comprises a securing means 134, which participates in the support of the bottle 6. This securing means 134 is configured to restrict movement between the bottle and the attachment means 10 in two opposite sense of the longitudinal dimension 5.

Said securing means 134 comprises a groove 138 located on the second portion 62 of the bottle 6. Said groove 138 can be continuous or doted around the bottle 6.

The securing means 134 also comprises at least one clipping mean 136, which is located on the circular portion 100 of the attachment means 10.

When the bottle 6 is inserted in the attachment means 10, the clipping mean 136 of the securing means 134 are deformed and pushed away from the bottle 6 due to the diameter of the bottle 6 being larger than the diameter defined by the clipping mean 136. When the bottle 6 is fully inserted in the attachment means 10, for example when the longitudinal end 64 is abutting at least one radial projections 130, the clipping mean 136 get into the groove 138, securing the attachment means 10 to the bottle 6. The securing means 134 authorize the separation of the bottle 6 and the attachment means 10. Any displacement of the bottle 6 along the longitudinal dimension 5 is restricted thanks to this securing means 134.

In a possible embodiment of the invention, the groove 138 is located on the attachment means 10 while the clipping mean 136 are located on the bottle 6.

Preceding description clearly illustrate how the invention fulfills its objective, as laid out in the preamble, and offers a heat exchanging module 1 comprising a bottle 6 and having a mean to attach the bottle 6 to said heat exchanging module 1 at two distinct portions of the bottle 6, said bottle being restricted in its longitudinal movement compared to the heat exchanger 2.

Several modifications and improvement might be applied by the person skilled in the art to the heat exchanging module 1 as defined above, as long as an attachment means 10 of a bottle 6 is implemented.

In any case, the invention cannot and should not be limited to the embodiments specifically described in this document, as other embodiments might exist. The invention shall spread to any equivalent mean and any technically operating combination of means.

The invention claimed is:

1. A heat exchanging module comprising:

a heat exchanger;

a bottle attached to the heat exchanger at a first longitudinal end of the bottle; and a stop portion located at a second longitudinal end of the bottle and extending in a plane perpendicular to the longitudinal dimension of the bottle, wherein the stop portion restricts at least one axial movement of the bottle along a longitudinal dimension of said bottle, and comprises at least two projections that are directed radially inwards, and separated from one another by a gap.

2. The heat exchanging module according to claim 1, wherein the stop portion comprises at least one portion extending in a plane perpendicular to the longitudinal dimension of said bottle.

3. The heat exchanging module according to claim 1, wherein the stop portion comprises a circular portion meant to fit at least partially around the bottle.

4. The heat exchanging module according to claim 1, wherein the heat exchanging module comprises a frame, the stop portion being mechanically connected to the frame.

5. The heat exchanging module according to claim 4, wherein the stop portion comprises a first connection means, and a second connection means, both first connection means and second connection means being connected to the frame.

6. The heat exchanging module according to claim 5, wherein the frame comprises at least a side wall and an end wall, the stop portion is connected to the side wall of the frame by the first connection means, and to the end wall of the frame by the second connection means.

7. The heat exchanging module according to claim 5, wherein the first connection means extends in an opposite and parallel direction to the second connection means.

8. The heat exchanging module according to claim 1, wherein the stop portion comprises at least one securing means that secures the bottle on the stop portion.

9. The heat exchanging module according to claim 8, wherein the at least one securing means comprising at least one mounting clip, and at least one groove which at least partially receives the mounting clip.

10. The heat exchanging module according to claim 1, wherein the bottle is attached to the heat exchanger at the first longitudinal end of the bottle by a coupling means, said coupling means comprises a mounting bracket and a mounting means, the mounting bracket comprising at least one duct which connect the bottle to the heat exchanger.

11. The heat exchanging module according to claim 1, wherein the heat exchanger is crossed by a first circuit configured to receive a refrigerant fluid and a second circuit configured to receive a coolant fluid.

* * * * *